US010344755B2

(12) United States Patent
Balenghien et al.

(10) Patent No.: US 10,344,755 B2
(45) Date of Patent: Jul. 9, 2019

(54) HYDRAULIC MACHINE COMPRISING ELONGATE MOUNTING PADS FOR REDUCING NOISE

(71) Applicant: TECHNOBOOST, Paris (FR)

(72) Inventors: Olivier Balenghien, Le Raincy (FR); Jean Christian Sirot, Paris (FR)

(73) Assignee: TECHNOBOOST, Paris (FR)

( * ) Notice: Subject to any disclaimer, the term of this patent is extended or adjusted under 35 U.S.C. 154(b) by 133 days.

(21) Appl. No.: 15/513,088

(22) PCT Filed: Sep. 9, 2015

(86) PCT No.: PCT/FR2015/052393
§ 371 (c)(1),
(2) Date: Mar. 21, 2017

(87) PCT Pub. No.: WO2016/051037
PCT Pub. Date: Apr. 7, 2016

(65) Prior Publication Data

US 2017/0292514 A1 Oct. 12, 2017

(30) Foreign Application Priority Data

Oct. 2, 2014 (FR) ..... 14 59413

(51) Int. Cl.
*F04B 39/12* (2006.01)
*F04B 53/00* (2006.01)
(Continued)

(52) U.S. Cl.
CPC ..... *F04B 53/003* (2013.01); *F04B 1/2064* (2013.01); *F04B 39/121* (2013.01);
(Continued)

(58) Field of Classification Search
CPC .... F04B 39/0044; F04B 39/121; F04B 39/14; F04B 53/003; F04B 53/22
See application file for complete search history.

(56) References Cited

U.S. PATENT DOCUMENTS 4,602,554 A 7/1986 Wagenseil
5,358,388 A 10/1994 Schutten
(Continued)

FOREIGN PATENT DOCUMENTS

DE 3413059 C1 7/1985
EP 1544464 A2 6/2005

OTHER PUBLICATIONS

International Search Report dated Nov. 20, 2015 from Corresponding International Application PCT/FR2015/052393.
(Continued)

*Primary Examiner* — F Daniel Lopez
(74) *Attorney, Agent, or Firm* — Sandberg Phoenix & von Gontard, P.C.

(57) ABSTRACT

The invention relates to a rotary hydraulic machine which includes a casing (2) containing pistons actuated by an input shaft, said casing having a transverse front surface provided so as to engage with a mounting, and a transverse rear surface receiving a rear cover (4) supporting collectors connected to said pistons, the casing comprising side attachment tabs (30, 40) each having an axial bore (32) ending in a rear clamping surface, provided such as to receive an element for clamping said machine to the mounting, characterized in that at least one tab forms an axially elongate pad (40), the height of which is greater than half of the length of said casing included between the front and rear surfaces thereof.

9 Claims, 2 Drawing Sheets

(51) Int. Cl.

| | |
|---|---|
| ***F04B 39/14*** | (2006.01) |
| ***F04B 1/20*** | (2006.01) |
| ***F04B 53/16*** | (2006.01) |

(52) U.S. Cl.
CPC ..... *F04B 39/14* (2013.01); *F04B 53/001* (2013.01); *F04B 53/16* (2013.01)

(56) References Cited

U.S. PATENT DOCUMENTS

| | | | | |
|---|---|---|---|---|
| 5,394,698 | A * | 3/1995 | Takagi | F16H 39/14 192/103 FA |
| 6,186,046 | B1 * | 2/2001 | Allart | F03C 1/0444 417/273 |
| 2005/0061143 | A1 * | 3/2005 | Koelzer | F04B 27/1072 92/71 |

OTHER PUBLICATIONS

Written Opinion dated Nov. 20, 2015 from Corresponding International Application PCT/FR2015/052393.

* cited by examiner

HYDRAULIC MACHINE COMPRISING ELONGATE MOUNTING PADS FOR REDUCING NOISE

CROSS-REFERENCE TO RELATED APPLICATIONS

This application is the US National Stage under 35 U.S.C. § 371 of International App. No. PCT/FR2015/052393 filed on Sep. 9, 2015, and which claims priority to French App. No. 1459413 filed on Oct. 2, 2014, all of which are incorporated herein by reference.

BACKGROUND

The present invention relates to a rotary hydraulic machine for a hybrid automotive vehicle, as well as a hybrid vehicle equipped with such a hydraulic machine.

A known type of hydraulic cylinder machine, shown in particular in U.S. Pat. No. 5,358,338, comprises, on the side conventionally called the front side, a motorized input shaft which rotates a barrel having a succession of parallel or slightly inclined cylinders, distributed around the axis of this shaft. Each cylinder receives a piston axially resting on the front side on an inclined plate, which is fixed in rotation around the shaft of the machine by means of a bearing forming an axial lug. The incline of this plate along an axis perpendicular to the shaft of the hydraulic machine can be fixed or variable in order to change the piston displacement of the hydraulic machine.

One rotation of the barrel gives each piston a movement in a complete cycle, comprising one stroke depending on the angle of incline of the plate, which is adjustable by an incline control. The rear face of the barrel, opposite the inclined plate, is supported on a fixed circular top plate closing the end of the cylinders, held by a cover, which includes low and high pressure manifolds.

These machines generally can be operated by a motor or pump. Alternatively, the piston displacement may be fixed, with an incline angle from the top plate which is constant.

During the operation of this type of machine, sudden variations in pressure in the cylinders are obtained, as well as flexings of various components due to periodic stresses exerted on the machine, which generate vibrations at frequencies related to the number of pistons and the rotational speed of the shaft, which are transmitted to the outer casing of this machine.

These rotating machines usually comprise a casing, forming a body containing the cylinders, having a front transverse surface for supporting and fixing the machine to a support, and a rear transverse surface for receiving the top plate which comprises the fluid manifolds.

In order to fasten these hydraulic machines to the support, it is known to form a flange, on the transverse front support, which comprises a balance centered on the shaft, and around which a number of transverse mounting lugs project laterally from the body of the casing, each lug comprising one axial bore. There are generally two, three or four lugs axially presenting a low height of between 10 and 20 mm.

The support receiving the rotary hydraulic machine comprises bores, each receiving a threaded screw in a bore of the casing lug, which is tightened by the screw head or by a nut coming to rest behind this lug. This type of mounting is sized to achieve a mechanical strength, and a fatigue resistance over the life of the machine.

The casing of the machine equipped with this type of fastening comprises unique modes of vibration which can be activated by the different pulses during the operation of the rotating machine. One problem that arises is that it is possible to obtain, depending on the rotational speed and the hydraulic pressure, screeching noises emitted by these modes of vibration.

In particular, this type of rotary hydraulic machine, generally designed for industrial applications with an acceptable sound level for this field, may be unsuitable for use in a hydraulic hybrid automotive vehicle where noise constraints are important to ensure the comfort of passengers.

In addition, various known methods make it possible to reduce the excitation levels of these hydraulic machines, including, for example, special forms of opening of the manifolds on the mounted circular top plate, as presented in the document cited above. However, these solutions increase the costs of the machines.

SUMMARY

The object of the present invention is to avoid in particular these disadvantages of the prior art.

To this end a rotary hydraulic machine is proposed, comprising a casing containing pistons actuated by an input shaft, the casing having a transverse front surface designed to rest against a support, and a transverse rear surface receiving a rear lid, supporting the manifolds connected to these pistons, the casing comprising lateral mounting lugs, each having an axial bore terminating in a rear tightening surface, designed to receive a tightening element from this machine on the support, characterized in that at least one lug forms an axially elongated pad, the height of which is greater than half the length of this casing between its front and rear surfaces.

One advantage of this hydraulic machine is that tests have shown that the lugs comprising a substantial height, greater than half the length of the casing, constitute a natural reinforcement from along the length of this casing, made more rigid by the screwing element passing through it, which recovers unique modes of flexion from the casing, and reduces the noise.

Machines with a reduced noise level and attenuated screeching noises may be obtained in a simple and economical manner.

The rotary hydraulic machine may further comprise one or more of the following features, which may be combined with one another.

According to one embodiment, the pads comprise the two axial ends which are aligned on the transverse front or rear surface of the casing.

Alternatively, the pads may comprise a front end recessed with respect to the transverse front surface.

The pads may also comprise a rear end set back from the transverse rear surface.

In addition, the rear lid may comprise pads aligned with those of the casing, the means of axial clamping passing through these two aligned pads.

In this case, the two aligned pads advantageously support one another on the level of the rear transverse surface.

Another object is the provision of a hydraulic hybrid vehicle comprising a drivetrain equipped with a rotary hydraulic machine, which comprises any of the preceding features.

DESCRIPTION OF THE FIGURES

The rotary hydraulic machine will be better understood and other characteristics and advantages will become more clearly apparent upon reading the following description, given by way of example and in a non-limiting manner, with reference to the accompanying drawings, in which.

DETAILED DESCRIPTION

Figure 1:
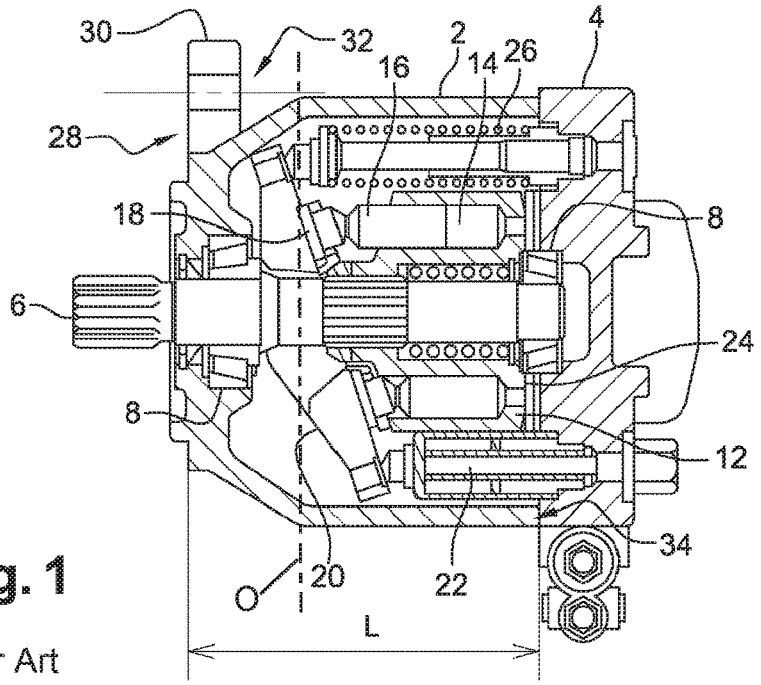
Fig. 1 Prior Art
FIG. 1 is a view in axial section of a rotary hydraulic machine according to the prior art.

FIG. 1 shows a hydraulic rotary machine in both directions of rotation, comprising a generally cylindrical casing 2 closed at the rear by a cover 4. The casing 2 and the cover 4 each support a conical roller bearing 8 guiding an input shaft 6 arranged along the axis of this body.

A barrel 12 rotationally connected to the input shaft 6 has nine cylinders 14 parallel to the axis and distributed around this axis. Each cylinder 14 contains a piston 16, the front end of which is supported by an axial lug 18 on an inclinable plate 20 which can pivot around an axis O perpendicular to the input shaft 6, under the effect of a hydraulic control cylinder 22 and a return spring 26.

The rear side of the barrel 12 bears on a transverse circular top plate 24 comprising orifices arranged opposite low and high pressure manifolds formed on the cover 4 which holds this top plate to close the rear end of the cylinders 14.

A complete cycle of movement for a pump functioning is obtained, for example, at each rotation of the barrel 12 from the assembly of pistons 16 sliding forward when they are opposite the low-pressure manifold, and then backwards when they are in front of the high pressure manifold to push the pressurized fluid inside.

The oscillations of the pressures as well as of the stresses in the various components excite unique modes of flexion peculiar to the casing 2, which thus generate the unpleasant noises.

The casing 2 has a transverse front surface 28 intended to come to rest on a support, and lugs 30 projecting laterally from this front surface, comprising a small axial height and each having an axial bore 32 receiving a threaded screw on this support.

The casing 2 has an axial length L which is the distance between its front surface 28 and the rear surface 34 which supports the cover 4.

Figure 2:
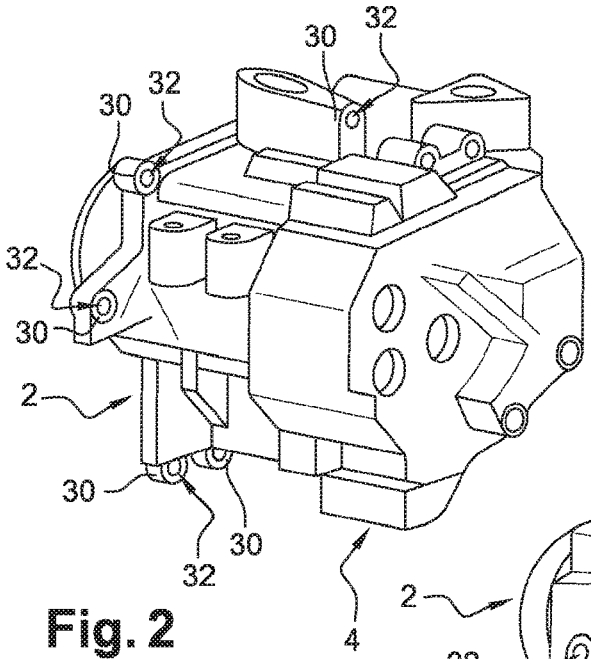
Fig. 2 Prior Art
FIG. 2 is an external view of a rotary machine, according to the prior art.

FIG. 2 shows a hydraulic machine comprising five visible lugs 30, distributed underneath, on the left side, and above the casing 2, in order to ensure regular tightening of the front surface of this machine on a support. Each of these lugs 30, as cast during the molding of the casing 2, has a small height which is calculated so as to be sufficient to ensure mechanical strength of the machine.

For this hydraulic machine the thickness of the walls of the casing 2 is thin enough, the wall exhibiting relatively low modes of unique flexion which can be excited during operation.

Figure 3:
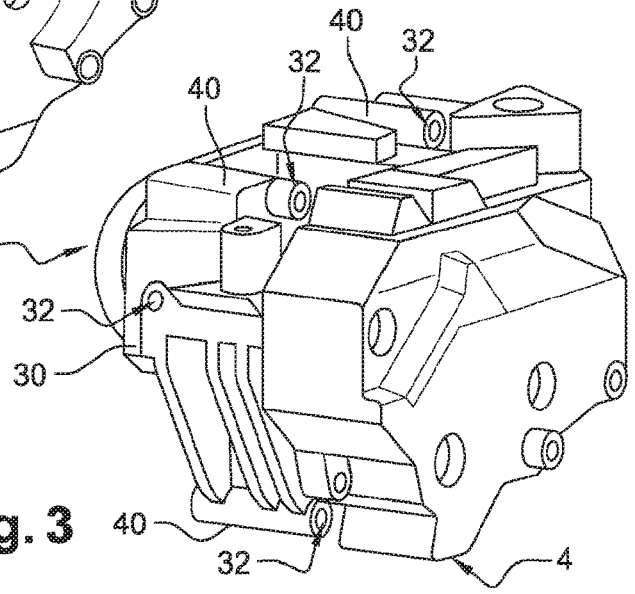
FIG. 3 is an external view of a rotating machine, according to the invention.

FIG. 3 shows the same hydraulic machine comprising the two lower lugs and the two upper lugs forming an axially elongated pad 40 which extends over the entire length L of the casing 2.

With the pads 40 projecting laterally out of the cover 4, the rear support surface of these pads is free to receive the support of an axial clamping means on the support, such as the head of a screw inserted into the bore 32, as well as a screwdriver bit.

It will be noted that the lug 30 arranged on the left side of the casing 2 does not form an elongated pad, because the volume available behind this lug does not allow the passage of a screwdriver bit.

Four pads 40 are thus distributed around the casing 2 which, in a simple and economical manner, with a minor modification to the mold of this casing, without changing the positions of the fastening bores of the support receiving this machine, offers a greater rigidity of this casing which raises its unique modes of flexion.

Figure 4:
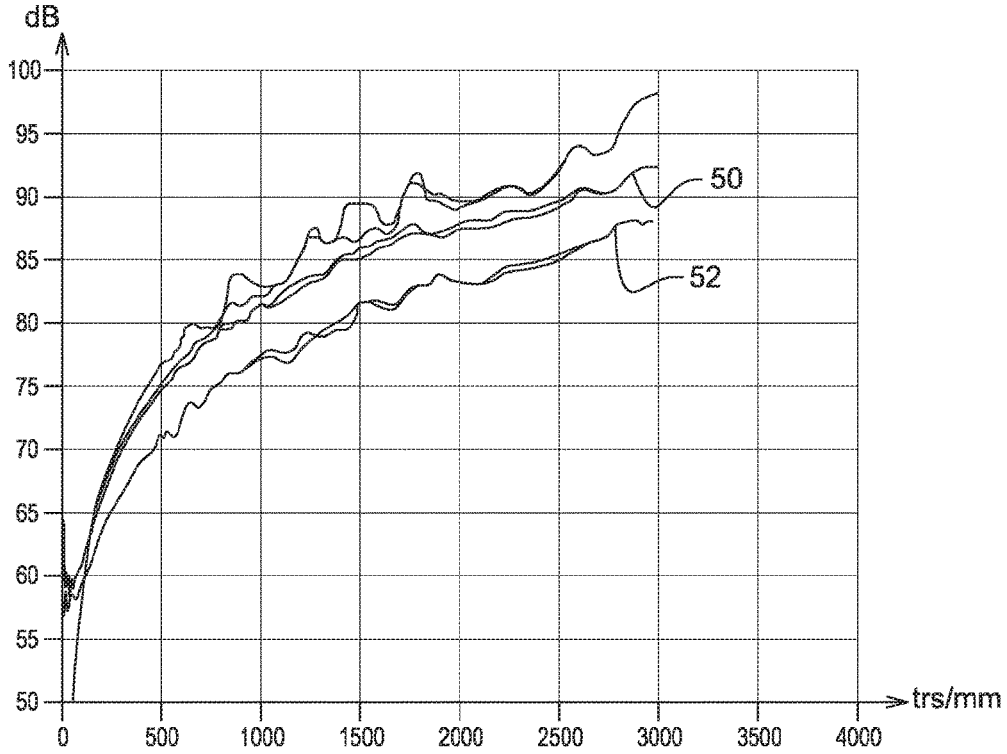
FIG. 4 is a diagram comparing the acoustic emissions of these two rotary machines.

FIG. 4 shows the sound emission level expressed in decibels on the vertical axis as a function of the speed of rotation of the input shaft, expressed in rpm on the horizontal axis.

The curve 50 shows the sound emission for the hydraulic machine according to the prior art shown in FIG. 2, and the curve 52 for the hydraulic machine modified according to the invention, shown in FIG. 3. A gain of about 5 dB is noted over the range of speed between 1000 and 3000 rpm.

Figure 5:
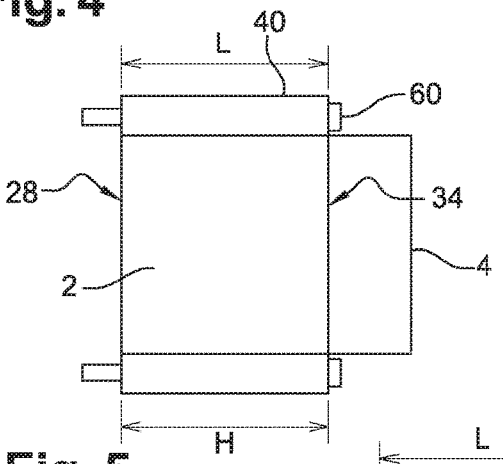
FIGS. 5, 6 and 7 are diagrams showing three types of fastening pads for a rotary machine according to the invention.

FIG. 5 shows a hydraulic machine comprising two pads 40 comprising a height H equal to the length L of the casing 2, each of which is traversed by an axial threaded screw 60.

Figure 6:
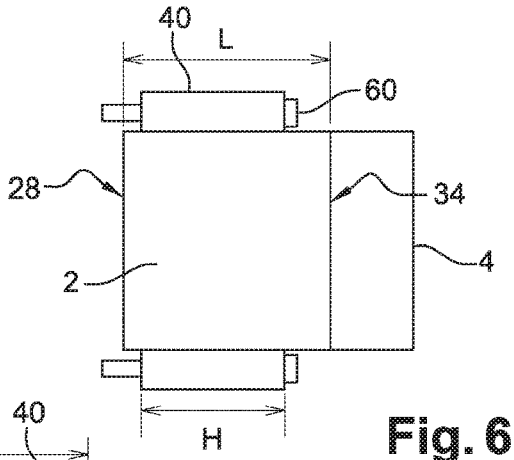

FIG. 6 shows a hydraulic machine comprising pads 40 having a front end slightly recessed from the front surface 28 of the casing 2, and a rear end also set back from the rear surface of this casing. The two pads 40 have a height H greater than half the length L of the casing 2.

Figure 7:
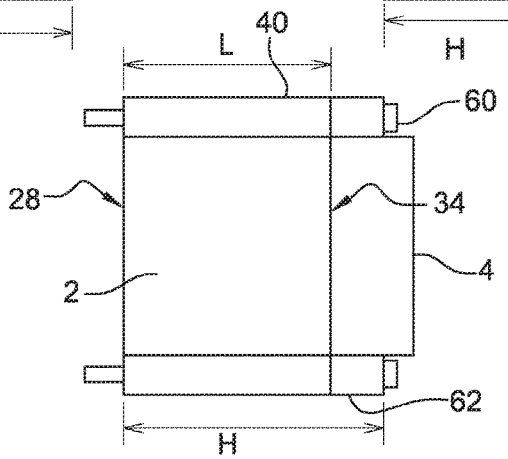

FIG. 7 shows a hydraulic machine comprising two pads 40 comprising a height H equal to the length L of the casing 2, each extending towards the rear by a complementary aligned pad 62 arranged on the rear cover 4. Each threaded screw 60 passes through the two aligned pads 40, 62 which rest one upon another at the rear transverse surface 34.

A complementary pad 62 may be arranged opposite some of the pads 40 of the casing 2. There will generally be complementary screws only tightening the rear cover 4 on the casing 2, in addition to those 60 arranged on these complementary pads 62, in order to ensure a good seal between these two elements.

These different solutions allow the screw heads 60 to axially manoeuver at different levels, depending in particular on the volumes required to accommodate these screw heads and the passage of the screwdriver bit.

The invention claimed is:

1. A rotary hydraulic machine mountable to a support, the rotary hydraulic machine comprising a casing containing pistons actuated by an input shaft, said casing having a transverse front surface for resting on the support and a rear surface receiving a rear cover supporting manifolds connected to the pistons; the casing defining a length (L) between the front surface and rear surface and comprising at least one elongate lug, said at least one elongate lug having an axial bore terminating in a rear tightening surface, the at least one elongate lug being designed to receive a tightening element to mount the machine on the support, wherein the at least one elongate lug has a height (H) which is greater than half the length (L) of the casing between its front and rear surfaces; the at least one lug having a front end set back from the transverse front surface.

2. The hydraulic machine according to claim 1, wherein said rear tightening surface of said at least one elongate lug being aligned with the transverse rear surface of the casing.

3. The hydraulic machine according to claim 1, wherein the rear cover comprises a complementary pad axially aligned with the elongate lug of the casing, the tightening element passing through the aligned at least one complementary pad and at least one elongate lug.

4. The hydraulic machine according to claim 3, wherein the aligned complementary pad and elongate lug rest against one another at the transverse rear surface.

5. A hydraulic hybrid vehicle comprising a drive train equipped with the rotary hydraulic machine of claim 1.

6. A rotary hydraulic machine mountable to a support, the rotary hydraulic machine comprising a casing containing pistons actuated by an input shaft, said casing having a transverse front surface for resting on the support and a rear surface receiving a rear cover supporting manifolds connected to the pistons; the casing defining a length (L) between the front surface and rear surface and comprising at least one elongate lug, said at least one elongate lug having an axial bore terminating in a rear tightening surface, the at least one lug elongate being designed to receive a tightening element to mount the machine on the support, wherein the at least one elongate lug forms has a height (H) of which is greater than half the length (L) of the casing between its front and rear surfaces; said rear tightening surface of the at least one lug set back from the transverse rear surface.

7. The hydraulic machine according to claim 6, wherein the at least one lug comprises a front end, said front end being aligned with the transverse front surface of the casing.

8. The hydraulic machine according to claim 6, wherein the rear cover comprises a complementary pad axially aligned with the at least one elongate lug of the casing, the tightening element passing through the aligned complementary pad and at least one elongate lug.

9. A hydraulic hybrid vehicle comprising a drive train equipped with the rotary hydraulic machine of claim 6.

* * * * *